United States Patent [19]

Nagaoka et al.

[11] Patent Number: 4,904,155

[45] Date of Patent: Feb. 27, 1990

[54] VACUUM PUMP

[75] Inventors: Takashi Nagaoka, Tsukuba; Ichiro Gyobu, Ibaraki; Kimio Muramatsu; Keiji Ueyama, both of Takasaki; Masahiro Mase, Ooaza Marubayashi; Yoshihisa Awada, Shimoinayoshi; Akira Nishiuchi, Shimoinayoshi, all of Japan

[73] Assignee: Hitachi, Ltd., Tokyo, Japan

[21] Appl. No.: 217,887

[22] Filed: Jul. 12, 1988

[30] Foreign Application Priority Data

Jul. 15, 1987 [JP] Japan ..... 62-174695

[51] Int. Cl.[4] ..... F01D 1/36

[52] U.S. Cl. ..... 415/90; 415/175; 415/177; 417/423.4; 222/146.4; 222/146.5

[58] Field of Search ..... 415/90, 175, 176, 177, 415/178, 47; 417/50, 423.4; 222/146.4, 146.5; 137/341; 219/364, 369, 370

[56] References Cited

U.S. PATENT DOCUMENTS

| | | | |
|---|---|---|---|
| 2,707,746 | 5/1955 | Gregg | 219/369 |
| 3,241,322 | 3/1966 | Strohmeyer, Jr. | 415/179 |
| 4,167,820 | 9/1979 | de Groot | 219/364 |
| 4,507,875 | 4/1985 | Hirsch et al. | 34/44 |
| 4,668,160 | 5/1987 | Mase et al. | 415/90 |
| 4,693,777 | 9/1987 | Hazano et al. | 156/345 |
| 4,767,914 | 8/1988 | Glucksman | 219/364 |
| 4,777,022 | 10/1988 | Boldish et al. | 373/117 |

FOREIGN PATENT DOCUMENTS 43197 3/1985 Japan .

*Primary Examiner*—Robert E. Garrett
*Assistant Examiner*—John T. Kwon
*Attorney, Agent, or Firm*—Antonelli, Terry & Wands

[57] ABSTRACT

A vacuum pump with a heating portion for preventing adhesion of reaction products on a discharge side thereof.

15 Claims, 5 Drawing Sheets

VACUUM PUMP

BACKGROUND OF THE INVENTION

1. Field of Industrial Utilization

This invention relates to a vacuum pump and, more particularly, to a vacuum pump which is suitable for preventing adhesion of reaction products by a process gas.

2. Prior art

Various vacuum pumps have recently been proposed in order to generate clean vacuum in apparatus for producing semiconductors. An example of such vacuum pumps is disclosed in, for example U.S. Pat. No. 4,668,160 wherein a gas sucked from a suction port is generally compressed sequentially while it passes through a flow path defined by a rotor and a stator and the compressed gas is discharged into the atmosphere.

In the vacuum pumps of this kind, materials in process gases handled in a semiconductor production apparatus which are likely to be solidified adhere and are deposited in the flow path and in order to remove such deposits easily, some vacuum pumps have a structure which can be disassembled and assembled easily, as disclosed in, for example, Japanese Utility Model Laid-Open No. 43197/1985.

In accordance with the prior art described above, the gas flow path is closed when the reaction products adhere or are deposited on the flow path of the process gas, so that the pump is disassembled in order to remove the deposits. Therefore, the operation of the semiconductor production apparatus connected to the vacuum pump must be stopped and the work efficiency is reduced.

SUMMARY OF THE INVENTION

It is therefore an object of the present invention to provide a vacuum pump which can prevent adhesion or deposit of reaction products on an exhaust path of the vacuum pump.

The object described above can be accomplished by providing a heating portion in the exhaust path of the vacuum pump.

Advantageously, according to the present invention, a heating portion disposed in the exhaust path heats the flow path and the gas or gases flowing through the flow path. Therefore, even when the reaction products adhere to the exhaust path, they are gasified by the heat from the heating portion and are not deposited to the extent of a thickness exceeding a predetermined thickness. As a result, clogging of the exhaust path due to adhesion of the reaction products can be prevented.

Other objects, features and advantages will be apparent from description of embodiments when taken in connection with the accompanying drawings.

DETAILED DESCRIPTION OF THE INVENTION

Figure 1:
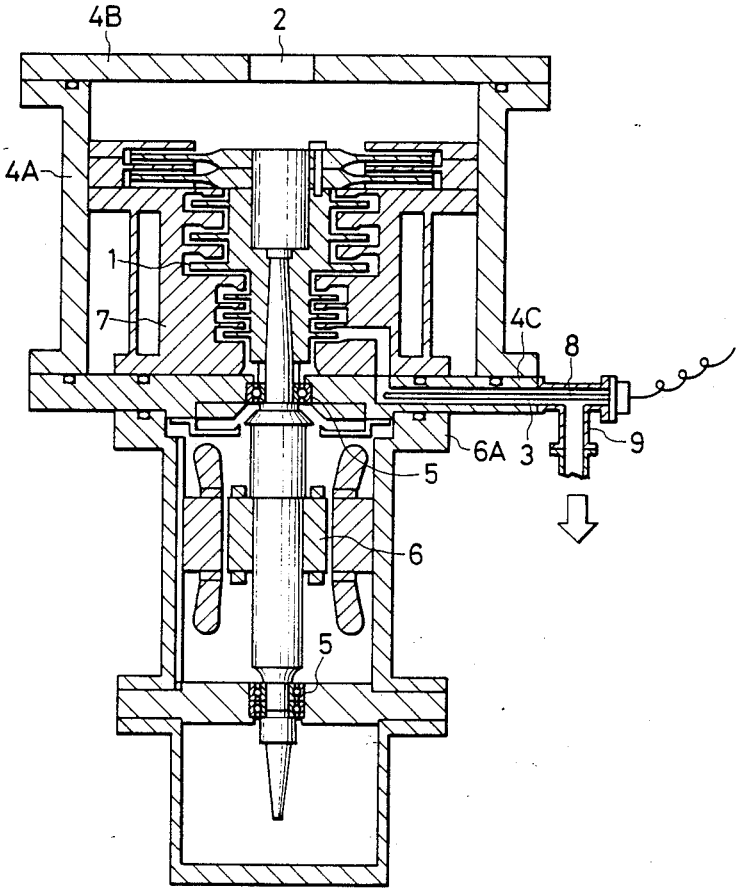
FIG. 1 is a longitudinal cross sectional view of a vacuum pump in accordance with one embodiment of the present invention.
Figure 2:
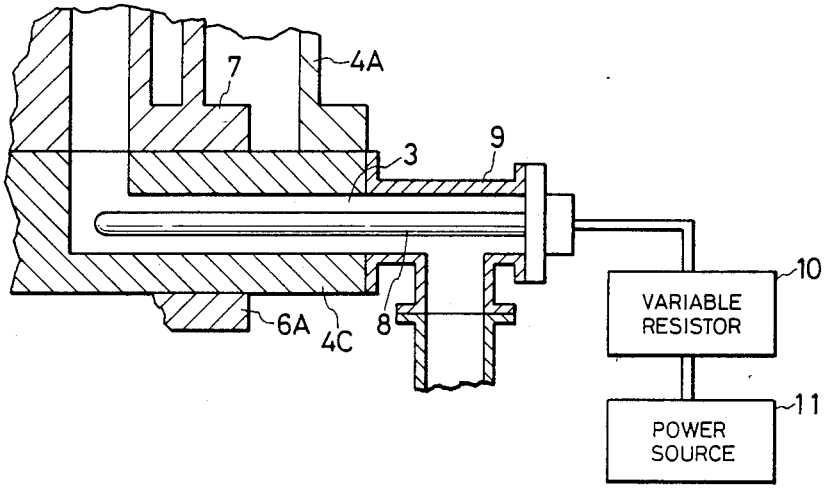
FIG. 2 is an enlarged longitudinal cross sectional view of portions of the vacuum pump shown in FIG. 1.

Referring now to the drawings wherein like reference numerals are used throughout the various views to designate like parts and, more particularly, to FIG. 1, according to this figure, a vacuum pump includes a rotor 1 having a plurality of vanes is rotatably supported by bearings 5 inside a main housing 4A and a motor housing 6A. A motor 6 is connected to the rotor 1 and a stator 7 is disposed on an inner wall of the main housing 4A. A first end plate 4B is disposed on one of the sides of the main housing 4A and a second end plate 4C is disposed between the other side of the main housing 4A and the motor housing 6A of the motor 6. A suction port 2 is formed on the first end plate 4B, with an exhaust path 3 reaching the vane portion of the final stage of the rotor 1 being formed in the second end plate 4C and the stator 7. A T-shaped pipe 9 is disposed in the second end plate 4C so as to communicate with the exhaust path 3. A heating member 8 is fitted into the exhaust path 3 through the T-shaped pipe 9 as shown in FIG. 2. The heating member 8 is rod-like and is connected to an electrical power source 11 as a heat source through a variable resistor 10 as a means for regulating the quantity of heat to be supplied from the heat source.

Figure 3:
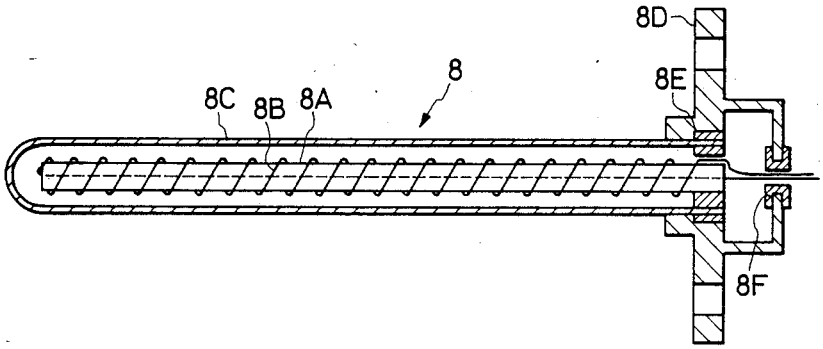
FIG. 3 is a cross sectional view of an example of the heating member used in the embodiment shown in FIG. 1.

As shown in FIG. 3, the heating member 8 includes a holding cylinder or holding tubular member 8A, a heating wire 8B would on the holding cylinder 8A, a protective cylinder or tubular member 8C covering the heating wire 8B, a fitting bracket 8D fitted to one end of each of a protective cylinder 8C and a holding cylinder 8A, and insulators 8E, 8F.

Figure 4:
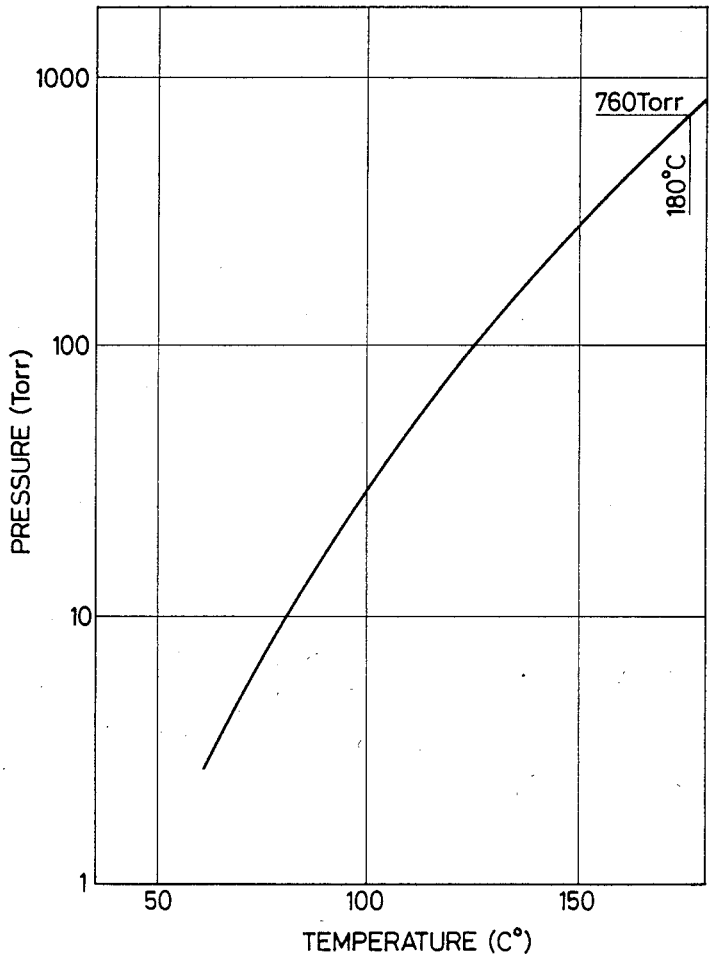
FIG. 4 is a vapor pressure diagram of aluminum chloride ($AlCl_3$)

In operation, the gas sucked from the suction port 2 is sequentially compressed inside the flow path defined by the rotor 1 and the stator 7 and is discharged near to the atmosphere from the exhaust path 3. In the exhaust process described above, the gas attains a high temperature at the portion where the rotor 1 rotates but the gas temperature drops near the exhaust path 3 because heat escapes to the housing 4A and the second end plate 4C. Therefore, when the suction side of the vacuum pump is connected to an aluminum dry etching apparatus of semiconductor devices, for example, $AlCl_3$ is formed as reaction product after etching. As can be seen from the vapor pressure diagram of $AlCl_3$ shown in FIG. 4, $AlCl_3$ turns to a solid at a temperature below about 180° C. near atmospheric pressure so that the reaction product flowing through the flow path is cooled on the inner wall of the exhaust path 3 and adheres to the inner wall. However, since this deposit is heated by the heating member 8 and gasified, it is possible to prevent clogging of the exhaust path 3 due to the deposit.

Figure 5:
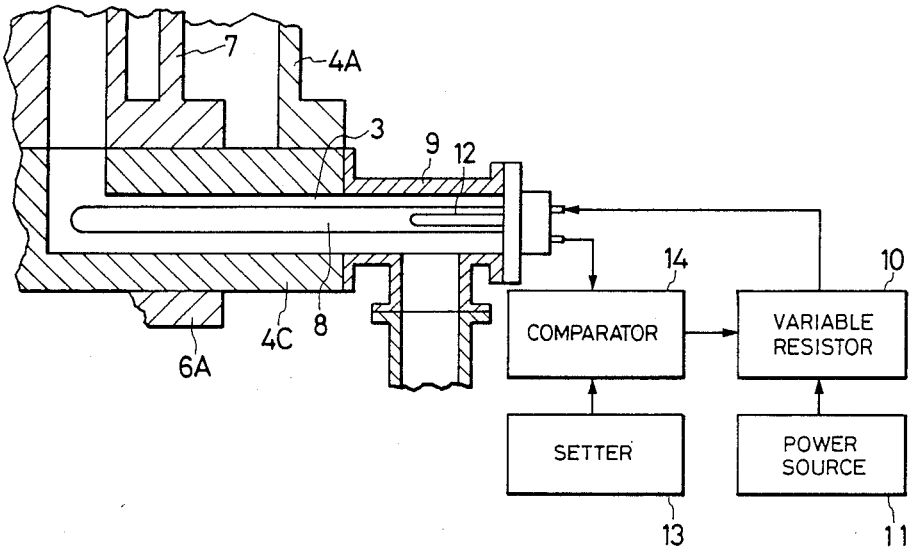
FIGS. 5 to 8 are cross sectional views respectively showing other embodiments of the present invention.

In the embodiment of FIG. 5, a temperature detector 12 is disposed inside the T-shaped pipe 9 constituting the exhaust path 3 in order to maintain the heating temperature of the heating member 8 at a constant temperature, with the detection temperature being detected by the temperature detector 12 compared with a set temperature, set in advance by a setter 13, by a comparator 14 which controls electric power supplied to the heating member 8 from a power source 10 by a variable resistor 10 so that the temperature of the heating member 8 attains the set temperature.

In accordance with the embodiment of FIG. 5, the temperature of the heating member 8 can be maintained at a constant level even though the flow velocity of the gas passing through the exhaust path 3 changes. As a result, deposition and build-up of the reaction products to the exhaust path 3 can be prevented.

Figure 6:
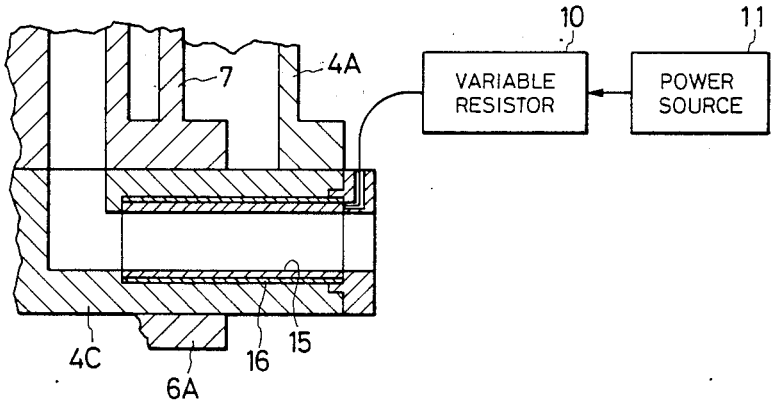

In the embodiment of FIG. 6, a cylindrical or tubular heating member 15 is disposed on the inner wall surface of the exhaust path 3, with an insulator 16 being disposed between the tubular heating member 15 and intersurface portion of the second and plate 4C.

In the embodiment of FIG. 6, deposition and build-up of the reaction products inside the exhaust path 3 can be prevented by heating and vaporizing the reaction products in the same manner as in the embodiment shown in FIG. 2.

Figure 7:
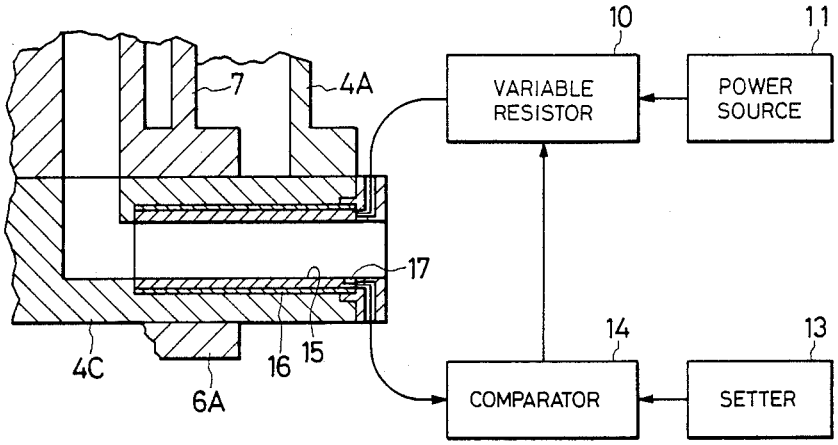

In the embodiment shown of FIG. 7, a temperature detection portion 17 is disposed at part of the heating member 15, for example, in order to maintain a constant exothermic temperature of the heating member 15 and to control the power supplied to the heating member 15 in accordance with the temperature detected by temperature detection portion 17. The same effect can be obtained in the embodiment of FIG. 7 as in the embodiment of FIG. 5.

Figure 8:
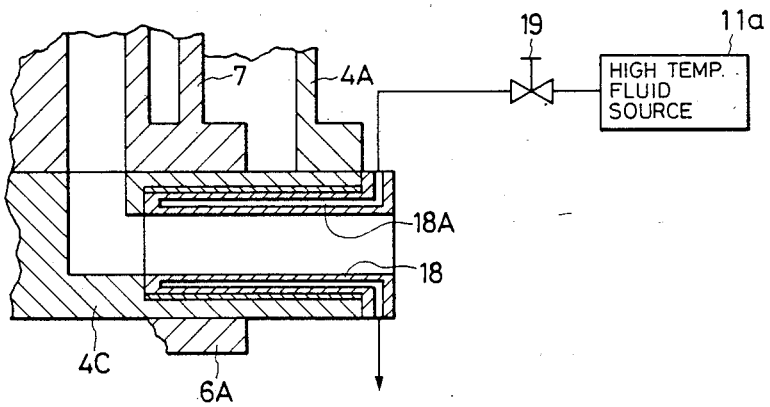

FIG. 8 shows still another embodiment of the present. In the embodiment of FIG. 8, a cylinder or tubular member 18 having, in a wall thereof, a space 18A into which a high temperature fluid from a high temperature fluid source 11*a* is supplied is disposed as the heating portion on the inner wall of the exhaust path 3, with a valve 19 being provided for controlling a flow rate of the high temperature fluid to be supplied to the space 18A.

According to the embodiment of FIG. 8, deposition and build-up of the reaction products can be prevented by the heat of the high temperature fluid supplied into the cylinder 18. In the embodiment of FIG. 8, the exothermic temperature from the cylinder 18 can be maintained constant in the same manner as the embodiments shown in FIGS. 5 and 7.

According to the present invention, since clogging of the pump exhaust path 3 can be prevented by vaporizing the reaction products in the process gas during the operation, the rates of operation of the vacuum pump and the production apparatus connected to the vacuum pump can be improved.

What is claimed is:

1. A vacuum pump comprising a housing having a suction port, an exhaust path, a rotor rotatably supported inside said housing, means for elevating a temperature and pressure of a process gas sucked from said suction port from compression of the process gas, means for discharging the process gas from said exhaust path reduced in pressure to near the atmospheric pressure, means for preventing adhesion of the solid reaction product in the discharging means including heating means disposed in said exhaust path for heating the solid reaction product.

2. The vacuum pump according to claim 1, wherein said heating means includes a heating member fixed to said housing in such a manner so as to be positioned inside said exhaust path.

3. The vacuum pump according to claim 1, wherein said heating means is disposed on an inner surface of said exhaust path.

4. The vacuum pump according to claim 3, wherein said heating means includes a tubular member arranged in said exhaust path so as to allow the process gas to flow into said tubular member and having, in a sidewall portion thereof, a space filled with a high temperature fluid extending in an axial direction of said tubular member.

5. The vacuum pump according to claim 3, wherein said heating means includes a tubular member arranged in said exhaust path so as to allow the gas to flow into said tubular member and having, in a side wall portion thereof, and extending in an axial direction of said tubular member a space filled with a high temperature fluid.

6. A vacuum pump comprising a housing including a suction port and an exhaust path, a rotor rotatably supported inside said housing, and means for sequentially compressing a process gas sucked from said suction path and discharging the same from said exhaust path at a pressure near to atmospheric pressure, the improvement comprising:

a solid reaction product prevention means including a heating means and a temperature detector means for detecting a temperature of said heating means, said heating means and said temperature detector means being disposed in said exhaust path;

a heat source connected to said heating means; means for adjusting a supply quantity of said heat source;

a temperature setter; and control means for controlling said heat supply quantity adjustment means by a set temperature from said temperature setter and a detected temperature from said temperature detector means so that reaction products of the process gas are prevented from adhering to the exhaust path.

7. The vacuum pump according to claim 6, wherein said heating means includes a heating member fixed to said housing in such a manner so as to be positioned inside said exhaust path.

8. The vacuum pump according to claim 6, wherein said heating means is disposed on an inner surface of said exhaust path.

9. The vacuum pump according to claim 8, wherein said heating means includes a tubular heating member.

10. The vacuum pump according to claim 8, wherein said heating portion is a tubular member forming a part of said exhaust path and having a space into which a high temperature fluid is supplied.

11. The vacuum pump according to one of claims 6, 7, 8 or 9, wherein said heat source includes an electrical power source and said heat supply quantity adjustment means includes a variable resistor.

12. The vacuum pump according to one of claim 6, 7, 8 or 9, wherein said means for sequentially compressing includes a plurality of vanes arranged to form multiple compression stages in cooperation with a stator dispored in said housing, whereby the process gas is sequentially compressed and discharged from said exhaust path.

13. A vacuum pump comprising a housing including a suction port, an exhaust path, a rotor rotatably supported inside said housing, and means for compressing a gas sucked from said suction port and for discharging the compressed gas from said exhaust path near to the atmosphere, the improvement comprising:

means for preventing adhesion of a solid reaction product of the process gas including a heating means and temperature detector means for detecting a temperature of said heating means, each being disposed in said exhaust path, said heating means is disposed on an inner surface of said exhaust path;

a heat source connected to said heating means, said heat source is a high temperature fluid source, said heating means includes a tubular member having a space into which a high temperature fluid from said high temperature fluid source is supplied;

means for adjusting a supply quantity of said heat source including a valve means;

a temperature setter; and control means for controlling said heat supply quantity adjustment means by a set temperature from said temperature setter and a detected temperature from said temperature detector means.

14. A vacuum pump for treatment of a process gas, the vacuum pump comprising means for sequentially compressing the process gas and discharge means for discharging the compressed gas elevated in temperature and pressure while allowing said compressed process gas to be cooled and to be reduced in pressure to around atmospheric pressure, means for preventing adhesion of a solid reaction product of a process gas comprising a heating means provided on said discharge means for preventing the compressed process gas passing through said discharge means from being cooled thereby preventing the solid reaction products of said process gas from adhering to said discharge means.

15. An apparatus for treatment of a process gas, the apparatus comprising means for elevating a temperature and pressure of the process gas through compression of the process gas, and a gas flow path of said apparatus causing said process gas, elevated in temperature and pressure, to cool in temperature and to be reduced in pressure, means for preventing adhesion of a solid reaction product formed by the compressed process gas when said compressed processed gas flows in said gas flow path including heating means provided in said gas flow path.

* * * * *